US009114626B2

(12) United States Patent
Zoltner et al.

(10) Patent No.: US 9,114,626 B2
(45) Date of Patent: Aug. 25, 2015

(54) METHOD FOR OPERATING A PRINTER TO PRINT RECYCLED INK WITH PROCESS BLACK NEUTRALIZATION

(71) Applicant: Xerox Corporation, Norwalk, CT (US)

(72) Inventors: Susan J. Zoltner, Newberg, OR (US); Nicholas C. Hill, Portland, OR (US); Steven Van Cleve Korol, Dundee, OR (US); Trevor James Snyder, Newberg, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/171,238

(22) Filed: Feb. 3, 2014

(65) Prior Publication Data

US 2014/0146100 A1 May 29, 2014

Related U.S. Application Data

(62) Division of application No. 13/353,124, filed on Jan. 18, 2012, now Pat. No. 8,662,649.

(51) Int. Cl.

| | |
|---|---|
| ***B41J 2/21*** | (2006.01) |
| ***B41J 2/175*** | (2006.01) |
| ***B41J 2/165*** | (2006.01) |
| ***B41J 2/18*** | (2006.01) |

(52) U.S. Cl.

CPC ..... *B41J 2/211* (2013.01); *B41J 2/16523* (2013.01); *B41J 2/175* (2013.01); *B41J 2/17593* (2013.01); *B41J 2/18* (2013.01); *B41J 2/2107* (2013.01)

(58) Field of Classification Search

CPC ..... B41J 2/1721

See application file for complete search history.

(56) References Cited

U.S. PATENT DOCUMENTS

| | | | |
|---|---|---|---|
| 4,256,470 | A | 3/1981 | Zajicek et al. |
| 4,314,264 | A | 2/1982 | Bok et al. |
| 4,320,407 | A | 3/1982 | Goldis et al. |
| 4,336,037 | A | 6/1982 | Goldis et al. |
| 4,460,903 | A | 7/1984 | Guenther et al. |
| 4,460,904 | A | 7/1984 | Oszczakiewicz et al. |
| 4,491,433 | A | 1/1985 | Shiurila et al. |
| 4,565,638 | A | 1/1986 | Zucker |
| 4,658,268 | A | 4/1987 | Needham |
| 4,792,292 | A | 12/1988 | Gaenzle |
| 5,126,752 | A | 6/1992 | Weinberg |

(Continued)

FOREIGN PATENT DOCUMENTS

| | | | |
|---|---|---|---|
| JP | 03151247 | | 6/1991 |
| JP | 2010264654 | A * | 11/2010 |

OTHER PUBLICATIONS

Machine generated English translation of JP2010-264654A, "Inkjet Printing Apparatus" to Nakajima et al.; retreived via http://www19.ipdl.inpit.go.jp/PA1/cgi-bin/PA1INDEX on Nov. 25, 2014; 10 pp.*

*Primary Examiner* — Shelby Fidler

(74) *Attorney, Agent, or Firm* — Maginot Moore & Beck LLP

(57) ABSTRACT

A method for recycling ink in an inkjet printer includes combining purged inks having two or more colors with black ink to form a mixed ink. The printer identifies an optical characteristic of the mixed ink and compares it to the optical characteristic for black ink. A controller for the printer adjusts the operation of the printer to form ink images having an optical characteristic that is closer to black ink than ink images formed with the mixed ink alone.

4 Claims, 4 Drawing Sheets

(56) References Cited

U.S. PATENT DOCUMENTS

| | | | | |
|---|---|---|---|---|
| 5,296,875 | A | 3/1994 | Suda | |
| 5,691,753 | A | 11/1997 | Hilton | |
| 5,956,062 | A | 9/1999 | Omata et al. | |
| 6,007,173 | A * | 12/1999 | DeLouise et al. | 347/7 |
| 6,139,136 | A | 10/2000 | Mackay et al. | |
| 6,145,954 | A | 11/2000 | Moore | |
| 6,193,363 | B1 | 2/2001 | Kelly | |
| 6,196,668 | B1 | 3/2001 | Bode | |
| 6,296,353 | B1 | 10/2001 | Thielman et al. | |
| 6,302,516 | B1 | 10/2001 | Brooks et al. | |
| 6,324,898 | B1 | 12/2001 | Cote et al. | |
| 6,341,852 | B1 * | 1/2002 | Yamamoto | 347/85 |
| 6,454,835 | B1 | 9/2002 | Baumer | |
| 6,513,918 | B1 | 2/2003 | Faisst et al. | |
| 6,517,189 | B2 | 2/2003 | Ogawa et al. | |
| 6,578,948 | B2 | 6/2003 | Shima | |
| 6,698,870 | B2 | 3/2004 | Gunther | |
| 6,799,842 | B2 | 10/2004 | Barinaga et al. | |
| 6,955,423 | B2 | 10/2005 | Rodriquez Mojica et al. | |
| 6,997,972 | B2 | 2/2006 | Tseng | |
| 7,048,353 | B2 | 5/2006 | Waller et al. | |
| 7,104,637 | B1 | 9/2006 | Van Steenkiste | |
| 7,150,519 | B2 | 12/2006 | Kono et al. | |
| 7,419,239 | B2 | 9/2008 | Brown et al. | |
| 7,449,051 | B2 | 11/2008 | Olsen | |
| 7,597,430 | B2 | 10/2009 | Umeda | |
| 7,611,568 | B2 | 11/2009 | Kang et al. | |
| 7,621,982 | B2 | 11/2009 | Kang et al. | |
| 7,625,080 | B2 | 12/2009 | Hess et al. | |
| 7,648,224 | B2 | 1/2010 | Sasa et al. | |
| 7,942,488 | B2 * | 5/2011 | Lang | 347/7 |
| 2003/0067518 | A1 | 4/2003 | Ishinaga et al. | |
| 2004/0114006 | A1 | 6/2004 | Phillips | |
| 2005/0146582 | A1 | 7/2005 | Platt et al. | |
| 2005/0151798 | A1 | 7/2005 | Merz et al. | |
| 2005/0285917 | A1 | 12/2005 | Nichols et al. | |
| 2006/0152558 | A1 | 7/2006 | Hoisington | |
| 2006/0244799 | A1 | 11/2006 | Sasa et al. | |
| 2007/0008372 | A1 | 1/2007 | Katada | |
| 2007/0081043 | A1 | 4/2007 | Silverbrook | |
| 2008/0007601 | A1 | 1/2008 | Tsai et al. | |
| 2008/0122901 | A1 | 5/2008 | Platt et al. | |
| 2008/0273071 | A1 | 11/2008 | Brown et al. | |
| 2008/0297577 | A1 | 12/2008 | Wouters et al. | |
| 2009/0322831 | A1 | 12/2009 | Emerton et al. | |
| 2010/0097417 | A1 | 4/2010 | Hill | |
| 2010/0123755 | A1 | 5/2010 | Korol et al. | |
| 2010/0123764 | A1 | 5/2010 | Slotto et al. | |
| 2010/0208018 | A1 | 8/2010 | Snyder et al. | |
| 2010/0309243 | A1 * | 12/2010 | Nakano et al. | 347/15 |

* cited by examiner

METHOD FOR OPERATING A PRINTER TO PRINT RECYCLED INK WITH PROCESS BLACK NEUTRALIZATION

CLAIM OF PRIORITY

This application is a divisional application of co-pending, commonly assigned U.S. patent application Ser. No. 13/353,124, which is entitled "Method and System For Printing Recycled Ink With Process Black Neutralization," and was filed on Jan. 18, 2012. This parent application issued as U.S. Pat. No. 8,662,649 on Mar. 4, 2014.

TECHNICAL FIELD

This disclosure relates generally to methods for recycling ink in an inkjet printer, and more particularly, to recycling phase change ink in a phase change ink inkjet printer.

BACKGROUND

In general, inkjet printing machines or printers include at least one printhead unit that ejects drops of liquid ink onto recording media or an imaging member for later transfer to media. Different types of ink may be used in inkjet printers. In one type of inkjet printer, phase change inks are used. Phase change inks remain in the solid phase at ambient temperature, but transition to a liquid phase when elevated to a melting temperature. The printhead unit ejects melted ink supplied to the unit onto media or an imaging member. Once the ink is ejected onto media, the ink droplets quickly solidify.

Phase change ink printers include one or more heaters that maintain a supply of phase change ink in a liquid state for use during printing operations. Some of the heaters maintain a supply of ink in the liquid state within reservoirs and other fluid conduits within the printheads. Typically, the heaters are electric heaters that consume electrical energy to maintain the phase change ink in a liquid phase. In order to reduce energy usage, phase change ink printers deactivate various components, including heaters, in the printer during a sleep mode to conserve energy. Loss of electrical energy during a sleep mode solidifies the ink held in the reservoirs and conduits.

The solidification of phase change ink within the printer presents issues for printing high quality documents when the printer emerges from sleep mode. As phase change ink within the printhead cools and solidifies, the ink contracts and air enters the reservoirs and fluid conduits within the printer. Reheating the solidified ink liquefies the ink and forms air bubbles in the liquefied ink. These air bubbles can prevent inkjets in the printhead from operating reliably. To eliminate air bubbles, a "purge" operation is performed. In a purge operation, pressure is applied to the reservoirs in the printheads to urge liquid ink and air bubbles through the nozzles of the inkjets in the printheads. The expelled ink flows down a face of the printhead and is collected in a waste ink receptacle. With the air bubbles removed from the melted ink, the inkjets are able to print ink drops reliably.

In existing printers, the purged ink is typically collected in a waste reservoir and is eventually discarded. Some printers have reclamation devices that reintroduce the waste ink into an ink supply instead of discarding the ink. In multi-color printers, however, the multiple colors of ink emitted during a purge operation often mix, and the resulting mixed ink is not suitable for direct reuse. In a printer using a common cyan, magenta, yellow, black (CMYK) color system, the mixed ink often appears to be dark brown or grey. The precise color of the mixed ink varies based on the types of ink used in the printer and on the proportional amounts of each ink that mix in the waste receptacle. Even in printers that do have separate waste reservoirs for various inks, the color quality of the individual inks may be reduced after a purge operation due to contaminants that are introduced into the purged ink.

One proposed ink reclamation apparatus pumps waste ink including one or more colors of ink into a black ink supply. Since the mixed ink colors have a darker color, the mixed waste ink and black ink mix together to form a color that approximates black closely enough for many print jobs. There are, however, limitations on the amount of mixed ink pumped into the black ink supply before the color of ink in the black ink supply deviates from the color of the pure black ink to a degree that negatively impacts image quality. Thus, much of the mixed waste ink cannot be recycled in existing printers without negatively affecting the image quality of printed images. Improvements to the printing process that enable greater reuse of purged ink in inkjet printers would be desirable.

SUMMARY

In one embodiment, a method of adjusting operation of a printing apparatus has been developed. The method includes combining at least two inks of different colors to form a mixed ink, identifying a value of an optical characteristic of the mixed ink, identifying a difference between the value of the optical characteristic of the mixed ink and a predetermined value of the optical characteristic for black ink, adjusting operation of the printer to enable the printer to form an ink image with the mixed ink that have a value of the optical characteristic that is closer to the predetermined value of the optical characteristic for black ink than the value of the optical characteristic of the mixed ink is to the predetermined value of the optical characteristic for black ink.

A printing apparatus that is configured to adjust tension on a media web has been developed a first printhead having a plurality of inkjets, the plurality of inkjets being arranged in at least two arrays of inkjets with one array being configured to eject black ink supplied by a first reservoir and at least one other array being configured to eject an ink having a color having a color other than black that is supplied by a second reservoir, a third reservoir positioned with reference to the first printhead to receive ink emitted from the first printhead onto a face of the first printhead, the third reservoir being fluidly connected to the first reservoir, and a controller operatively connected to the first printhead and the third reservoir, the controller being configured to: move ink from the third reservoir to the first reservoir to form a mixed ink, identify a value of an optical characteristic of the mixed ink, identify a difference between the value of the optical characteristic of the mixed ink and a predetermined value of the optical characteristic for black ink, and adjust operation of the printer to enable the printer to form an ink image with the mixed ink that has a value of the optical characteristic that is closer to the predetermined value of the optical characteristic for black ink than the value of the optical characteristic of the mixed ink is to the predetermined value of the optical characteristic for black ink.

BRIEF DESCRIPTION OF THE DRAWINGS

The foregoing aspects and other features of a system that prints using recycled ink such that the recycled ink appears to be black are explained in the following description, taken in connection with the accompanying drawings.

DETAILED DESCRIPTION

Figure 1:
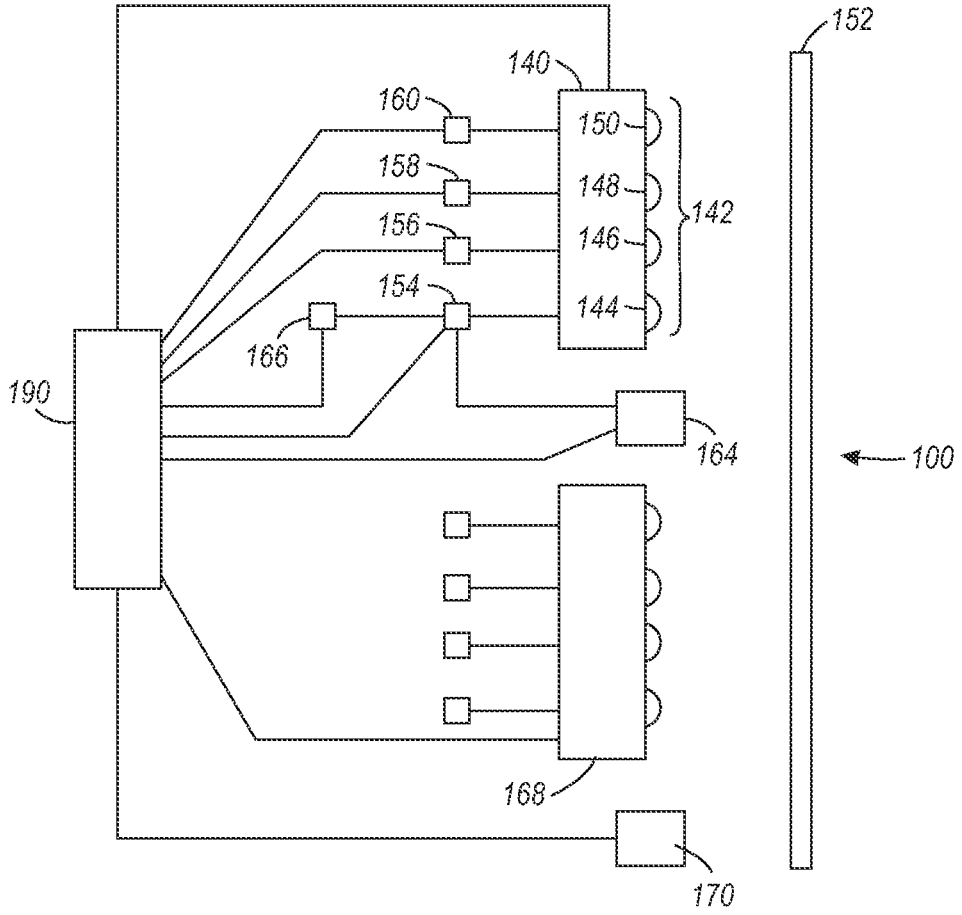
FIG. 1 is a schematic diagram of an inkjet printing system configured to print using recycled ink.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces images on media for any purpose, such as a digital copier, bookmaking machine, facsimile machine, a multi-function machine, or the like. The systems and methods described below may be used with various printer embodiments. A direct printer ejects ink drops directly onto print media to form ink images on the media and subsequently fixes the ink image to the media sheet. An indirect printer forms an ink image on an intermediate image receiving member, such as a drum or endless belt, and transfers the ink image to a media sheet in a "transfix" operation that is well-known in the art. A "media sheet" or "print medium" as used in this description may refer to any type and size of medium on which printers in the art produce images, including printer paper of various sizes. Each media sheet includes two sides, and each side may receive an ink image corresponding to one printed page.

As used herein, the term "image receiving member" refers to any member having a surface that is configured to receive an ink image. In a direct printer, the image receiving member is typically print media, such as a paper sheet or continuous media web. In an indirect printer, the image receiving member is typically a rotating drum or endless belt that receives ink ejected by one or more printheads to form ink images. In a direct printer, a media transport carries print media along a media path past printheads in a print zone, while in an indirect printer the image receiving member rotates or moves past the printheads in a repeating manner. As used herein, the term "process direction" refers to a direction of travel of an image receiving member, such as an imaging drum or print medium, and the term "cross-process direction" is a direction that is perpendicular to the process direction along the surface of the image receiving member. Also, as used in this document, "black ink" refers to an ink or other marking material that is intended or is suitable, by its predetermined optical properties, to produce the color black, such as by the control software associated with the printer; or, alternatively, an ink that meets customer satisfaction requirements for the color black, such as when used for printing text.

Phase change ink printers use phase change ink, also referred to as a solid ink, which has a solid state at room temperature but melts into a liquid at a higher operating temperature. A printhead ejects the liquid ink drops onto an image receiving member in either a direct or indirect printer. Both direct and indirect printers apply a coating of release agent to selected components in the printer to prevent phase change ink from adhering to the printer components instead of the print medium. In one embodiment, the release agent is an oil such as silicone oil.

Figure 5:
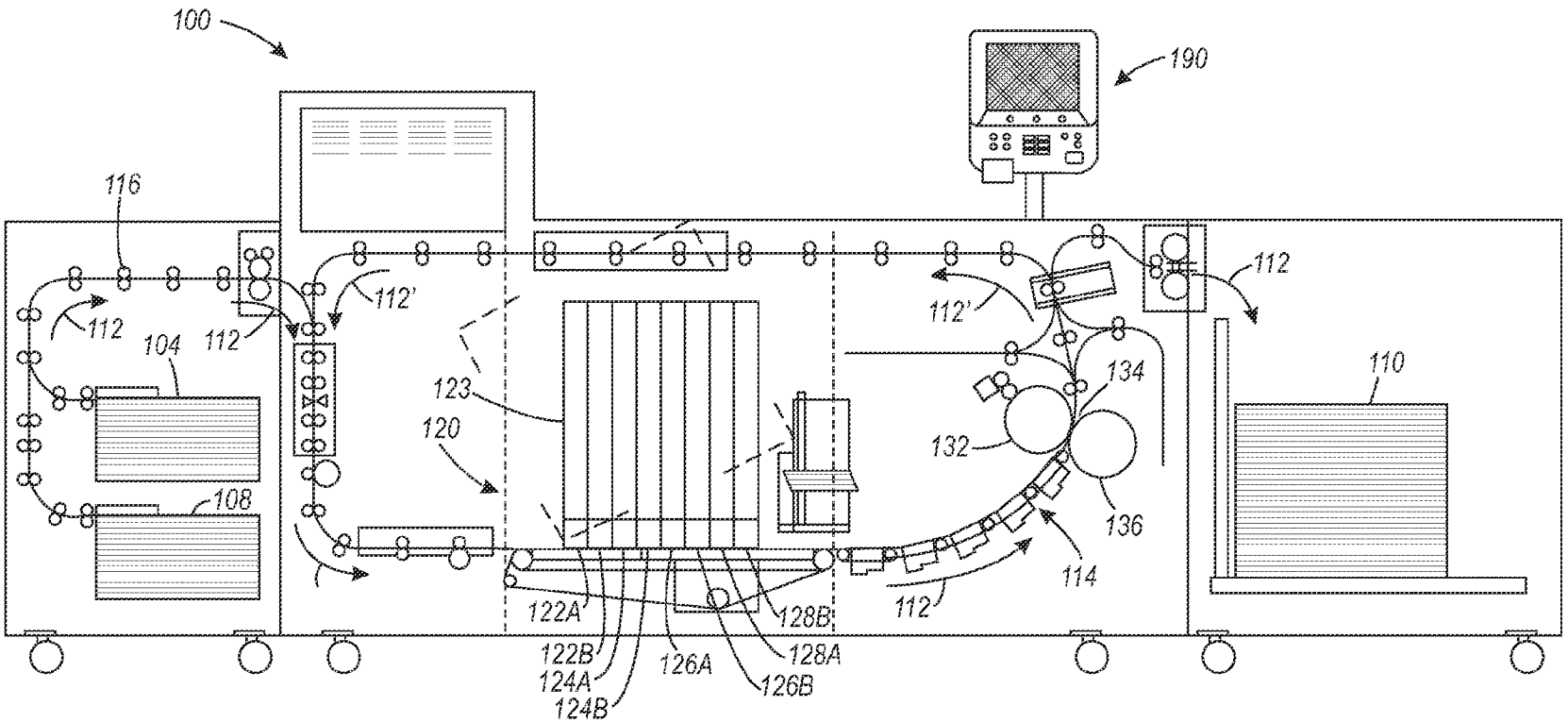
FIG. 5 is a schematic view of an inkjet printer that is configured to print images directly onto media sheets.

FIG. 5 depicts a direct inkjet printer 100 that can be modified as shown in FIG. 1 to print images with recycled ink. Printer 100 includes media supplies 104 and 108, a media path 112, print zone 120, a media sheet conveyor 114, spreader roller 132, pressure roller 136, media output tray 110, and a controller 190.

The media supplies 104 and 108 hold a plurality of media sheets and supply the media sheets to the printer via the media path 112 for printing. In the embodiment of printer 100, the media supplies 104 and 108 can hold media sheets of different sizes. For example, the media supply 104 holds size A4 (210 mm×297 mm) media sheets, while the media supply 108 holds tabloid size media sheets (279 mm×432 mm). In alternative configurations, either or both media supplies 104 and 108 hold media sheets having letter size (215.9 mm×279.4 mm), legal size (216 mm×356 mm), or various other sheet sizes. Various printer embodiments move the media sheets in either a length or width orientation during printing. Thus, the "length" of a media sheet in the process direction can be either of the length or width dimensions commonly used to describe a media sheet size. For example, the length of a letter size media sheet in the process direction can be either 215.9 mm or 279.4 mm depending on the orientation of the media sheet as a media transport moves the media sheet in a process direction through the printer.

During a print job, media sheets from one or both of the media supplies 104 and 108 move along the media path 112. The media path 112 is a media transport that includes a plurality of guide rollers, such as guide rollers 116, which engage each media sheet and move the media sheets through the printer 100. In FIG. 5, the media path 112 guides each media sheet past a print zone 120 in a process direction for imaging operations on a first side of each media sheet. A portion of the media path 112' reverses an orientation of the media sheets and directs the media sheets through the print zone 120 a second time in the process direction to enable the print zone 120 to print ink images during imaging operations on the second side of each media sheet.

The print zone 120 includes a plurality of printheads arranged in a cross-process direction across a width of each media sheet. In FIG. 5, the print zone 120 includes a total of eight marking stations configured to print color images using a combination of cyan, magenta, yellow, and black (CMYK) inks. In one embodiment, each printhead in the marking stations 122A and 122B ejects magenta ink, each printhead in the marking stations 124A and 124B ejects cyan ink, each printhead in the marking stations 126A and 126B ejects yellow ink, and each printhead in the marking stations 128A and 128B ejects black ink. Each of the marking stations 122A-128B includes a plurality of printheads that each includes a plurality of inkjets.

The printheads in each set of marking stations 122A-122B, 124A-124B, 126A-126B and 128A-128B are arranged in interleaved and staggered arrays to enable printing over the entire cross-process width of a media sheet. For example, marking station 122A includes one array of staggered printheads that print images at a resolution of 300 drops per inch (DPI) in the cross-process direction over a media sheet. Each printhead in the staggered array covers a portion of the width of the media sheet, and the printheads are aligned end-to-end in the cross-process direction to print a continuous line of ink drops across the media sheet. Marking station 122B includes a second staggered array of printheads that are interleaved with the printheads in the marking station 122A to enable both of the marking stations to print magenta ink with a combined resolution of 600 DPI in the cross-process direction.

In alternative configurations, each marking station has a single printhead that extends across the width of the media path 112 and ejects multiple colors of ink. For example, a single printhead could be configured with four arrays of inkjet ejectors, each of which prints a different color of cyan, magenta, yellow, or black ink. The other marking stations could be similarly configured with a single printhead that ejects multiple ink colors. Again, a printhead in one marking station is interleaved with a printhead in another marking station to increase the cross-process resolution of printing.

In the print zone 120, the printheads in each marking station print liquid drops of a melted phase change ink. In one embodiment, the ink is supplied as a series of solid ink sticks to each of the marking stations 122A-128B. A heater positioned in each marking station melts solid ink to supply liquid ink to the corresponding printhead(s) of a marking station. As depicted in FIG. 5, each marking station includes a set of supporting electronics 123. The electronics 123 include driver electronics, which generate the signals that operate the printheads in the marking station operatively connected to the driver electronics. The printheads are also supplied with ink from a supply. In one alternative configuration, two marking stations that print a single color of ink receive melted solid ink from a single supply. In another alternative configuration, the solid ink is supplied as granular pastilles rather than as ink sticks. While printer 100 uses phase-change ink, the methods described herein can also be used in inkjet printers using alternative forms of ink including aqueous, gel, solvent based, and UV curable inks.

A media sheet moves through the print zone 120 to receive an ink image and the media path 112 moves the media sheet out of the print zone 120 in the process direction. The printheads in marking stations 122A-128B eject ink drops onto a predetermined area of the surface of the media sheet as the media sheet moves through the print zone to form an ink image on the media sheet. A section of the media path 112 located after the print zone 120 includes one or more conveyors 114. The conveyors 114 are configured to control the velocity of the media sheet in the process direction as the media sheet approaches a nip 134 formed between spreader roller 132 and pressure roller 136.

FIG. 1 depicts a schematic view of a portion of the printer 100 that has been modified to enable ink to be collected from a face of a printhead ejecting multiple ink colors and returned to the black ink supply for use by the printhead. The modified printer includes a first printhead 140, an image receiving member 152, a first ink reservoir 154, a second ink reservoir 156, a third ink reservoir 158, a fourth ink reservoir 160, a reclaimed ink reservoir 164, a black ink reservoir 166, a second printhead 168, an optical sensor 170 and a controller 190. The controller 190 is operatively connected to the driver electronics operating the first printhead 140, the ink reservoirs 154, 156, 158, 160, 164, 166, the driver electronics operating the second printhead 168, and the optical sensor 170.

The first printhead 140 includes a plurality of inkjets 142 arranged in a plurality of arrays 144, 146, 148, 150. In FIG. 1, each array of inkjets is schematically represented by a single semi-circular projection extending from the printhead 140. The semi-circles are used to show generally where the inkjets of an array can be located, however, in an actual printhead, the inkjets of an array do not extend outwardly from the printhead, but are integrated in the printhead and open into apertures at the surface thereof. The same is true of all of the arrays of inkjets schematically depicted in FIGS. 1-3. Thus, the reference numbers 144, 146, 148, 150 of FIG. 1 point to the back sides of the semi-circles used to represent the inkjet arrays. Together, the arrays comprise the plurality of inkjets 142 for a printhead.

Each array is configured to eject a color of ink different than the other arrays in the printhead. The first array 144 is configured to eject black ink in response to the signals received from the driver electronics under the control of the controller 190. The second array 146 is configured to eject magenta ink in response to the signals received from the driver electronics under the control of the controller 190. The third array 148 is configured to eject cyan ink in response to the signals received from the driver electronics under the control of the controller 190. The fourth array 150 is configured to eject yellow ink in response to the signals received from the driver electronics under the control of the controller 190.

The first ink reservoir 154 supplies ink to the first inkjet array 144. The black ink reservoir 166 supplies ink to the first ink reservoir 154. Additionally, the reclaimed ink reservoir provides mixed ink collected from the face of the printhead 140 to the first ink reservoir 154. This structure enables the mixed ink to be reused as the black ink and mixed ink can be proportionally mixed to produce an ink that approximates black ink. The second ink reservoir 156 supplies magenta ink to the second inkjet array 146, while the third ink reservoir 158 supplies cyan ink to the third inkjet array 148, and the fourth ink reservoir 160 supplies yellow ink to the fourth array 150.

When the printer 100 prints an image, the controller 190 sends timing and signal parameters to the driver electronics that generate the electrical driving signals that selectively operate the inkjets in the arrays 144, 146, 148, and 150 of the printhead 140. The ejected ink drops form an ink image on the image receiving member, which in FIG. 1 is print media. From time to time, maintenance operations are performed in which one or more of the arrays in the printhead 140 are purged. Purging is the application of pressure to the ink within a printhead to emit ink through the apertures in the face of the printhead. This purged ink flows out of the apertures onto the face of the printhead and then moves downwardly across the face to one or more drip points at the bottom of the printhead. In some embodiments, a wiper is also provided that acts as a squeegee and wipes the purged ink towards the drip points. In the embodiment shown in FIG. 1, the reclaimed ink reservoir 164 is positioned beneath these drip points to collect the purged ink. When the printhead has multiple arrays that eject different colors of ink, the ink in the reclaimed ink reservoir 164 is a combination of the different colors. In the embodiment shown in FIG. 1, the ink in the reclaimed reservoir is a mixture of magenta, cyan, yellow and black ink.

Each ink color in the mixture has a color value, which can be measured and quantified using a variety of color spaces. Although the description below uses the L*a*b* color space other color spaces, such as a RGB color space, can be used. In each color space, the color values of the mixed ink are determined with reference to the image data and a particular color space. Then a difference is identified between the identified color values in the selected color space and a predetermined color value for black ink in the color space. This difference refers to a quantifiable amount between color values that may or may not be perceptible to the human eye. Ink drops of at least one of a cyan, magenta, and yellow ink are ejected onto mixed ink ejected onto the imaging receiving member to form a combined ink image. The difference between the color values of the combined image and the predetermined color value of black ink is smaller than a difference between the color space values for the mixed ink and the predetermined color space value of black ink.

One example of this method is implemented with reference to the L*a*b* color space, which measures color on three dimensions. The "L*" dimension corresponds to lightness wherein a value of zero yields black and a value of 100 yields white. The "a*" dimension corresponds to the amount of magenta present in the color. Positive "a*" values indicate the presence of magenta and negative "a*" values indicate green. The "b*" dimension corresponds to the amount of cyan or yellow in the color. Positive "b*" values indicate the presence of cyan and negative "b*" values indicate the presence of yellow. Thus, any ink color can be described in three dimensional space with reference to the three color vectors of black, cyan, and magenta.

The magenta ink stored in the second ink reservoir 156 and supplied to the second array 146 of inkjets 142 on the first printhead 140 has a specific L*a*b* value corresponding to magenta. Similarly, the cyan, yellow and black inks stored in their respective reservoirs 158, 160, 166 and supplied to their respective arrays 148, 150, 144 each have specific L*a*b* values corresponding to cyan, yellow and black. The mixed ink in the reclaimed ink reservoir 164 is a mixture of magenta, cyan, yellow and black ink and thus forms a color with an L*a*b* value that is different from the L*a*b* values of the individual ink colors ejected by the printhead. The L*a*b* value of the mixed ink depends upon how much ink of each color was collected in the reclaimed ink reservoir 164.

The color value of the mixed ink in the reclaimed ink reservoir 164 can be measured in a variety of ways. In one embodiment, the controller 190 calculates a color value for the mixed ink in the reclaimed ink reservoir 164 with reference to the number of inkjets purged from each array and the number of times the inkjets of an array is purged. The proportion of each ink color in the reclaimed ink reservoir 164 is monitored and maintained in memory until the reclaimed ink is moved from the reclaimed reservoir 164 to the reservoir 154. These amounts are used by the controller to compute a L*a*b* value for the mixed ink. Once the mixed ink is removed from the reclaimed reservoir, the controller resets the stored amounts of the various ink colors and begins accumulation of the purged amounts for subsequent purges.

In another embodiment, the controller 190 calculates a L*a*b* value for the mixed ink in the reclaimed ink reservoir 164 with reference to an electrical current measurement. The reservoir 164 is configured with a pair of electrodes positioned within the volume of the reservoir at a location covered by the mixed ink once a predetermined amount of ink has been collected by the reservoir. The controller 190 connects one electrode to a current source and measures the amount of current received at the other electrode. This electrical current measurement is compared to stored values of current measurements that are correlated to L*a*b* values. The stored current measurements and corresponding L*a*b* values are determined empirically and stored in the controller 190. For electrical current measurements between the empirically determined values, the controller 190 interpolates an appropriate L*a*b* value.

In another embodiment, the controller 190 calculates a color value for the mixed ink in the reclaimed ink reservoir 164 by printing a test pattern with the mixed ink and the ink in the reservoir 154. The controller 190 operates a pump (not shown) that is operatively connected to the controller 190 and the conduit between the reservoir 154 and the reservoir 164 to move mixed ink to the reservoir 154. This combined ink is supplied to the first inkjet array 144 and ejected onto the image receiving member 152. The optical sensor 170 generates image data corresponding to the mixed ink on the image receiving member 152. The controller 190 executes programmed instructions that implement an image analysis process that identifies the color value of the mixed ink with reference to the image data generated by the optical sensor 170. In one embodiment, the optical sensor includes an array of optical detectors mounted to a bar or other longitudinal structure that extends across the width of an imaging area on the image receiving member. In this embodiment, the imaging area is approximately twenty inches wide in the cross process direction and the printheads print at a resolution of 600 dpi in the cross process direction. The optical sensor includes over 12,000 optical detectors that are arrayed in a single row along the bar to generate a single scanline across the imaging member. The optical detectors are configured in association in one or more light sources that direct light towards the surface of the image receiving member. The optical detectors receive the light generated by the light sources after the light is reflected from the image receiving member. The magnitude of the electrical signal generated by an optical detector in response to light being reflected by the bare surface of the image receiving member is larger than the magnitude of a signal generated in response to light reflected from a drop of ink on the image receiving member. This difference in the magnitude of the generated signal may be used to identify the positions of ink drops on an image receiving member, such as a paper sheet, media web, or print drum. Thus, the contrast may be used to identify an intensity for the mixed ink. The magnitudes of the electrical signals generated by the optical detectors are converted to digital values by an appropriate analog/digital converter. These digital values are denoted as image data in this document and these data are analyzed to identify a L*a*b* value for the mixed ink.

Once the color value of the mixed ink has been identified, the controller 190 can operate the printer to change the color value of the mixed ink, if necessary, to eject an ink that is relatively close to the color value of black ink. In one embodiment, the controller operates a valve or pump or both to add black ink to the mixed ink in the first ink reservoir 154 before supplying ink to the first inkjet array 144. The controller 190 identifies the color value of the mixed ink using one of the aforementioned processes and then identifies an amount of black ink that brings the color value of the ink in the reservoir 154 within a predetermined range about the black ink color value. The controller 190 then transfers mixed ink from the reclaimed ink reservoir 164 and black ink from the black ink reservoir 166 in the appropriate proportions to produce an acceptable color of ink in the first ink reservoir 154.

In another embodiment, one of the processes noted above identifies the color value of the ink in the reservoir 154. The controller 190 then determines locations on an area to be printed with the mixed ink in the reservoir 154 that can be overprinted with one or more of the magenta, cyan and/or yellow inks to produce a color value within the predetermined range about the black ink color value. The inks overprinted on the area can be printed by the printhead from which the ink was collected or from another printhead in one of the other marking stations within the printer.

Figure 2:
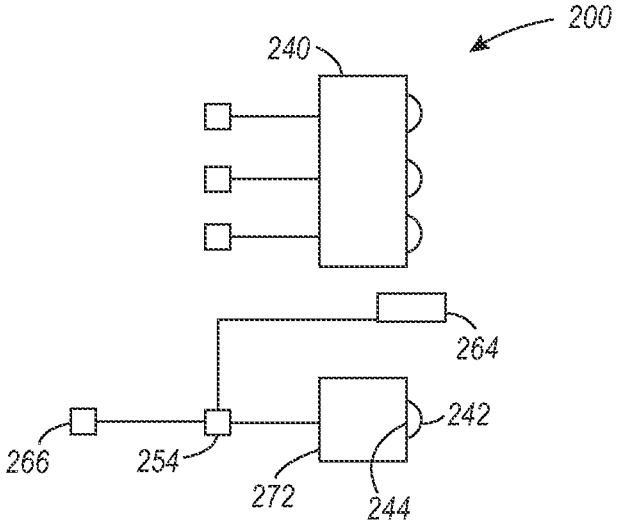
FIG. 2 is a schematic diagram of another inkjet printing system configured to print using recycled ink.

FIG. 2 depicts a portion of a printer 200. Printer 200 is substantially similar to the printer 100 described above, however, the printer 200 includes a first printhead 240 that is not supplied by a black ink reservoir 266. In this embodiment, the reclaimed ink reservoir 264 only collects magenta, cyan and yellow ink. The reservoir 254 is operatively connected to the black ink reservoir 266 and the reclaimed ink reservoir 264. The reservoir 254 supplies the mixture of the black and collected ink to a first inkjet array 244 in printhead 272. The printhead 272 ejects only black ink in one embodiment and ejects at least two colors of ink, one of which is black, in another embodiment. The color value of the ink ejected by the first inkjet array 244 is controlled as described above with reference to the printhead in FIG. 1.

Figure 3:
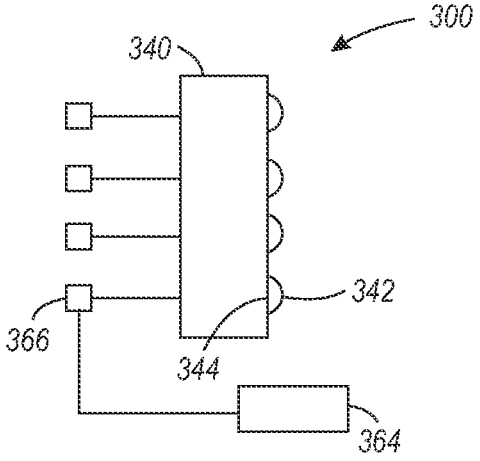
FIG. 3 is a schematic diagram of another inkjet printing system configured to print using recycled ink.

FIG. 3 depicts a portion of a printer 300. Printer 300 is substantially similar to the printer 100 described above, however, the printer 300 includes a reclaimed ink reservoir 364 that is fluidly connected to a black ink reservoir 366 rather than to a first ink reservoir. In this embodiment, the controller 190 operates a pump or value or both to move mixed ink from the reclaimed reservoir 364 to the black ink reservoir 366. The reservoir 366 is fluidly connected to the inkjet array 344 to enable the array to eject the ink from the reservoir 366. Again, the color value of the ink ejected by the first inkjet array 344 is controlled as described above with reference to the printhead in FIG. 1.

Figure 4:
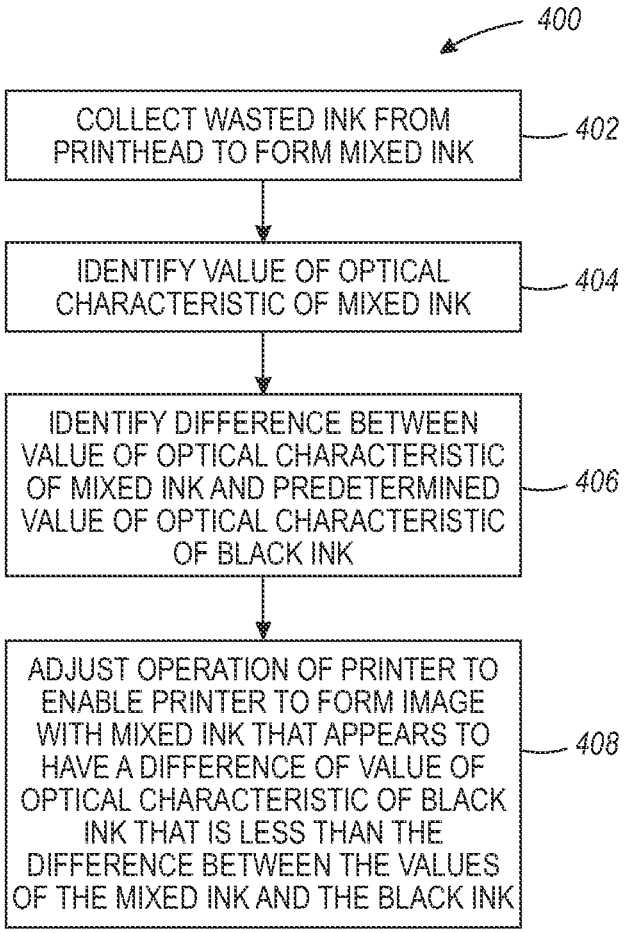
FIG. 4 is a flow diagram of an example of a process useful for operating the printer of FIG. 1, FIG. 2 or FIG. 3.

A process 400 by which the printer 100, 200 or 300 is operated to reuse mixed ink is shown in FIG. 4. As shown in FIG. 4, a reclaimed ink reservoir collects purged ink from a printhead (block 402). A controller identifies a value of an optical characteristic of the mixed ink (block 404). This identification is performed in one of the manners previously identified above. The controller identifies a difference between the value of the optical characteristic of the mixed ink and a predetermined value of the optical characteristic for black ink (block 406). The controller then adjusts the operation of the printer to enable the printer to form an ink image with mixed ink from the reclaimed ink reservoir that appears more like black ink than does the ink from the reclaimed ink reservoir (block 408). The controller adjusts printer operation by proportionally combining other inks in a reservoir supplying an inkjet array ejecting black ink or by ejecting other ink colors onto an area printed with the mixed ink as explained above.

In operation, one or more printheads are configured with a reclaimed ink reservoir to collect one or more colored inks from a printhead. The combined ink is supplied to an array of inkjets that eject black ink. A controller monitors an optical characteristic of the combined ink and adjusts the operation of the printer to enable the printer to use the combined ink to produce a color in ink images that is visually imperceptible from black ink. The adjustment in some embodiments includes the mixing of black ink with the combined ink to attenuate the color of the combined ink and shift it toward the color value of black ink. In other embodiments, the combined ink is ejected and other colors of ink printed over the ejected combined ink at predetermined locations to produce a color on the image receiving member that is visually imperceptible from the color value of black ink. The optical characteristic of the combined ink is determined in one embodiment by monitoring the amounts of different colors of ink collected to produce the mixed ink. In other embodiments, the color value of the mixed ink is determined with reference to the electrical conductivity of the mixed ink and in another embodiment is determined with reference to the intensity of light reflected by the mixed ink. These color values are then used to adjust the operation of the printer.

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

We claim:

1. A method of operating a printer comprising:

combining at least two inks of different colors in a reservoir in the printer to form a mixed ink, each ink of the at least two inks forming the mixed ink having a color other than black;

identifying with a controller in the printer a value of an optical characteristic of the mixed ink by applying an electrical current to a first electrode positioned in the mixed ink within the reservoir, identifying a conductivity of the mixed ink with reference to an amount of the electrical current received at a second electrode positioned in the mixed ink within the reservoir, and identifying the value of the optical characteristic of the mixed ink with reference to the identified conductivity;

identifying with the controller a difference between the value of the optical characteristic of the mixed ink and a predetermined value of the optical characteristic for black ink; and adjusting operation of the printer with the controller by adding black ink to the mixed ink in the reservoir in a proportion that produces an ink having a value of the optical characteristic that is closer to the predetermined value of the optical characteristic for black ink than the value of the optical characteristic of the mixed ink before the black ink is added to enable the printer to form an ink image with the mixed ink, the ink image formed with the mixed ink having the value of the optical characteristic that is closer to the predetermined value of the optical characteristic for black ink than the value of the optical characteristic of the mixed ink before the black ink is added.

2. The method of claim 1, the optical characteristic being luminance.

3. The method of claim 1, the optical characteristic being hue.

4. The method of claim 1 further comprising:

emitting the inks of at least two colors other than black from a plurality of inkjets in at least one printhead;

collecting the emitted ink in the reservoir; and fluidly connecting the reservoir to a reservoir that supplies black ink to one other printhead in the printer.

* * * * *